US012729554B2

(12) United States Patent
Fränkel et al.

(10) Patent No.: US 12,729,554 B2
(45) Date of Patent: Sep. 8, 2026

(54) UNDERWATER CLEANER

(71) Applicants: Andrés Fränkel, Perchtoldsdorf (AT); Benjamin Fränkel, Perchtoldsdorf (AT); Constantin Fränkel, Perchtoldsdorf (AT)

(72) Inventors: Andrés Fränkel, Perchtoldsdorf (AT); Benjamin Fränkel, Perchtoldsdorf (AT); Constantin Fränkel, Perchtoldsdorf (AT)

( * ) Notice: Subject to any disclaimer, the term of this patent is extended or adjusted under 35 U.S.C. 154(b) by 321 days.

(21) Appl. No.: 18/130,617

(22) Filed: Apr. 4, 2023

(65) Prior Publication Data

US 2023/0374806 A1 Nov. 23, 2023

(30) Foreign Application Priority Data

Apr. 5, 2022 (AT) ..... A 50218/2022

(51) Int. Cl.
*E04H 4/16* (2006.01)

(52) U.S. Cl.
CPC ..... *E04H 4/1636* (2013.01)

(58) Field of Classification Search
CPC ..... E04H 4/1636
See application file for complete search history.

(56) References Cited

U.S. PATENT DOCUMENTS

2005/0108836 A1* 5/2005 Rowan ..... E04H 4/1636 15/1.7
2005/0247613 A1 11/2005 Bishop et al.
2016/0145884 A1* 5/2016 Erlich ..... E04H 4/1654 15/1.7
2020/0080331 A1* 3/2020 Dufilho ..... E04H 4/1636

FOREIGN PATENT DOCUMENTS

CN 106639391 A * 5/2017 ..... B63B 59/08
EP 3141675 B1 12/2018
EP 2989270 B1 10/2019
EP 3832053 A1 6/2021

OTHER PUBLICATIONS

CN 106639391 Translation (Year: 2017).*

* cited by examiner

*Primary Examiner* — Eric J Rosen
(74) *Attorney, Agent, or Firm* — Dykema Gossett PLLC

(57) ABSTRACT

The invention relates to an underwater cleaner, in particular for a swimming pool, with a housing in which in particular a battery-powered pump with an electric motor and an impeller rotatable about an impeller axis of rotation is arranged, with a suction nozzle—defining a suction plane—formed by the housing, and a flow channel which is arranged in the housing and accommodates the impeller, is designed to be inclined with respect to the suction plane and which extends between an inlet opening arranged in the region of the suction nozzle and an outlet opening, wherein a receptacle for a filter device is arranged in the region of the outlet opening, and wherein the housing together with the suction nozzle can be manufactured by injection molding and the flow channel can be molded by a slider which can be pulled in the longitudinal direction of the flow channel.

18 Claims, 8 Drawing Sheets

UNDERWATER CLEANER

CROSS-REFERENCE TO RELATED APPLICATION

This application claims the benefit of priority to Austria application No. A 50218/2022, filed 5 Apr. 2022.

BRIEF SUMMARY

The invention relates to an underwater cleaner, in particular for a swimming pool, with a housing in which a particularly battery-powered pump with an electric motor and an impeller is arranged, with a suction nozzle—defining a suction plane—formed by the housing, and with a flow channel which is arranged in the housing and accommodates the impeller, is designed to be inclined to the suction plane and which extends between an inlet opening arranged in the region of the suction nozzle and an outlet opening, wherein a receptacle for a filter device is arranged in the region of the outlet opening, and wherein the housing together with the suction nozzle can be manufactured by injection molding, and wherein the flow channel can be molded by means of a slider which can be pulled in the longitudinal direction of the flow channel.

BACKGROUND

From EP 3 832 053 A an underwater cleaner is known whose housing can be manufactured by injection molding. The flow channel is arranged vertically, i.e. at a right angle to the suction plane, with the outlet from the flow channel being arranged at the highest point of the housing. In the region of the outlet, a collar-like receptacle is provided for a filter container. The vertical orientation of the flow channel has the disadvantage that, after the drive motor for the impeller has been switched off, resoiling can occur as a result of dirt particles falling out of the filter device. In order to prevent resoiling, specially designed filter devices are required. The impeller is located far from the suction level and close to the outlet opening, as a result of which relatively high drive powers are required to achieve acceptable suction results.

Furthermore, a hand-held swimming pool vacuum cleaner is known from EP 2 989 270 B1, the housing of which has a lateral outlet opening to which a collection container for dirt is connected. Above the outlet opening, the housing has a rigid receptacle for a guide rod. The housing is assembled from multiple parts. The flow channel cannot be molded with sliders by injection molding.

Known from EP 3 141 675 B1 is an underwater cleaner with a housing in which a battery-powered pump with an electric motor and an impeller is arranged, wherein the housing has an inlet opening and an outlet opening for a flow path. The flow path has a first channel section extending from the first inlet opening and a second channel section accommodating the impeller. The second channel section is arranged inclined to the first channel section, wherein the impeller axis is arranged inclined with respect to a normal to the opening cross-section of the inlet opening.

US 2005/0247613 A1 discloses an underwater vacuum cleaner in which the impeller axis of rotation is arranged inclined with respect to a normal to an inlet cross-sectional area. A first channel section with a tapering cross-section, which opens into a suction chamber in which a dirt filter is arranged, is arranged adjacent to the inlet opening of the underwater vacuum cleaner. From this suction chamber, a second channel section extends in which a pump with a radial impeller is arranged. The inlet cross-section to the pump is relatively small. Due to numerous deflections and sharp edges, turbulences occur, in particular downstream of the first channel section, which limit the suction power.

Known underwater vacuum cleaners are either costly to manufacture, have poor efficiency, or exhibit deficiencies in cleaning results.

SUMMARY OF THE INVENTION

It is the object of the invention to develop an underwater vacuum cleaner that is as simple as possible, is inexpensive to manufacture and effective and which has a high suction and cleaning efficiency. In particular, resoiling from the filter device is to be prevented.

The object is achieved with an underwater cleaner of the type mentioned above in that the flow channel—at least in the region of the outlet opening—is inclined with respect to a normal to the suction plane, wherein at least one reference line formed by the central axis of the flow channel and/or a surface line of the flow channel encloses an acute angle with the suction plane, at least in the region of the outlet opening. Preferably, the reference line encloses an angle ≤75°, preferably ≤60°, particularly preferably ≤5°, with the suction plane, at least in the region of the outlet opening.

Thus, the outlet opening is not arranged in a ceiling region, but in a side region of the housing. As a result, resoiling from the filter device is prevented when the electric motor is switched off.

The flow channel starts directly from the suction nozzle and is designed in a single pass, i.e. without deflections and subdivisions into several subchannels. The inclined arrangement of the straight or circular flow channel allows filtering devices with stiffer materials and higher filtration efficiency to be used without the need for additional flaps to prevent resoiling. The inclined shape of the flow channel permits a larger suction area for the same>diameter than a flow channel which—as in EP 3 832 053 A—is designed at right angles to the suction plane.

To enable easy demolding of the flow channel by means of a slider, it is advantageous if the reference line is designed as a straight line or as a circular line. In the case of a straight flow channel, a straight slider can be used, and in the case of an arc-shaped flow channel, an arc-shaped slider can be used. The slider is pulled, for example, from the side of the outlet opening.

In this case, the flow channel can have, for example, a circular-cylindrical, elliptical or oval cross-section, wherein the surface lines preferably run substantially parallel to the central axis of flow. The flow channel can thus have a substantially identical flow cross-section between the inlet opening and outlet opening. Alternatively, the flow cross-section of the flow channel can be designed to be continuously increasing, for example conical, in the pulling direction of the slider—for example in the flow direction between the inlet opening and outlet opening.

Advantageously, an accommodation space for a battery is integrated in the housing, wherein the accommodation space is preferably arranged on a side of the flow channel facing away from the suction plane. The accommodation space for the battery is arranged in a space-saving manner in a region of the housing where it neither impairs the suction function nor obstructs the function of the filter device or the guidance of the underwater cleaner by means of a guide rod.

In one embodiment of the invention, it is provided that the inlet opening has a—preferably substantially elliptical— inlet cross-sectional area which is larger than a cross-sectional area of the flow channel, measured normal to the channel center axis—preferably in the region of the outlet opening. Preferably, the inlet cross-sectional area is arranged parallel to the suction plane. This enables a high suction effect.

Particularly good cleaning results can be achieved if the ratio A/B of the inlet cross-sectional area A to the flow cross-sectional area B of the flow channel measured normal to the channel center axis—preferably in the region of the outlet opening—is between 1.4 and 2.3, preferably 1.9±10%.

According to an embodiment according to the invention, the rotational axis of the impeller is arranged eccentrically in the flow channel, wherein the eccentricity measured between the rotational axis of the impeller and the channel center axis is at most 10% of the largest diameter of the flow channel. The eccentric design allows the underwater cleaner to be short and compact.

In a preferred embodiment of the underwater cleaner, the impeller is designed as an axial impeller, which has the advantage that relatively large flow rates and thus a particularly high suction capacity can be achieved. The impeller is preferably arranged in the region of the inlet opening of the flow channel. As a result, a high suction effect can be achieved with low drive power, so that relatively high-mass dirt particles such as sand grains or small stones can also be sucked in. Alternatively, it is also possible within the context of the present invention to arrange the impeller in the region of the outlet opening of the flow channel. This also enables a short design of the underwater cleaner.

An optimum cleaning effect can be achieved if the outlet opening and the receptacle for the filter device are arranged on an actuating side of the suction nozzle housing facing the user. The filter device is thus arranged on the rear side of the underwater cleaner facing the user, so that during "forward travel" of the underwater cleaner, thus, when the underwater cleaner is pushed with the guide rod, the filter device formed by a filter bag, for example, is stretched and the best suction effect can thus be achieved. In this case, the filter device can be formed by an inexpensive simple filter bag or a filter container made of a rigid material. Due to the inclined design of the flow channel, there is no risk that the filter device could block the outlet opening. Furthermore, the disadvantage of a suction-side filter device that dirt particles fall out of the underwater cleaner again when the underwater cleaner is lifted out of the pool and when the underwater cleaner is switched off can be avoided.

Within the context of the invention, it is further provided that a rod receptacle for detachable connection to a guide rod is arranged on a guide fork, which rod receptacle is connected to the housing or to the suction nozzle to be pivotable about a pivot axis, wherein the guide fork preferably encompasses the flow channel on both sides in at least one pivot position.

In one embodiment of the invention, it is provided that—as seen in plan view—the pivot axis is arranged spaced apart from a center of mass of the underwater cleaner, wherein the center of mass is arranged between the pivot axis and the outlet opening. When the underwater cleaner is lifted by means of the guide rod, the outlet opening with the filter device folds downwards so that the opening of the filter device is directed upwards. As a result, dirt particles can be prevented from falling out of the filter device and out of the underwater cleaner again when the suction cup is lifted out of the pool and when the underwater cleaner is switched off. Non-return valves to prevent resoiling can be completely dispensed with.

BRIEF DESCRIPTION OF THE DRAWINGS

The invention is explained in more detail below with reference to the non-limiting exemplary embodiments illustrated in the figures. In the figures.

DETAILED DESCRIPTION

Figure 1:
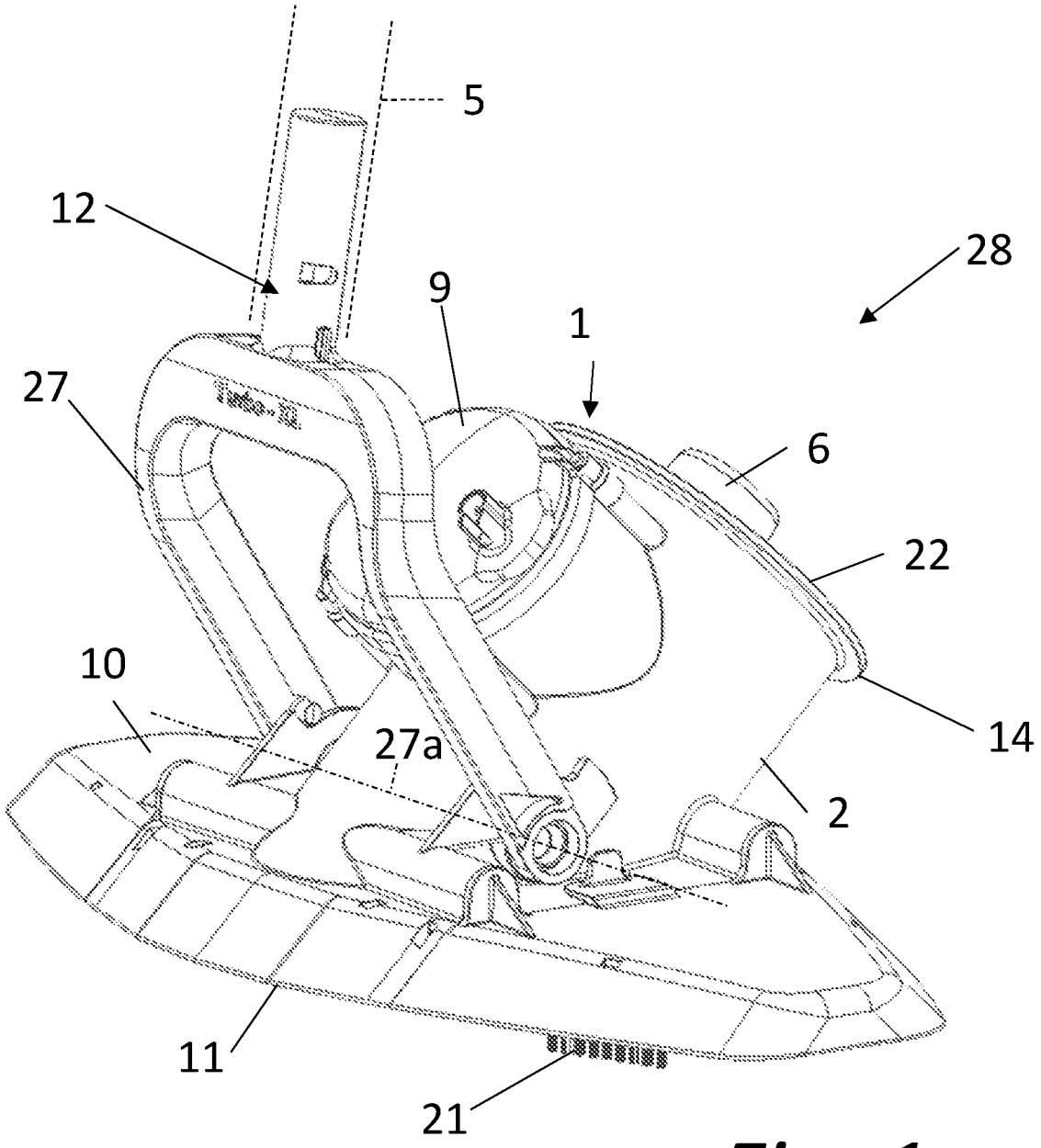
FIG. 1 shows the underwater cleaner according to the invention in a first pivot position of the guide fork in an axonometric illustration.
Figure 2:
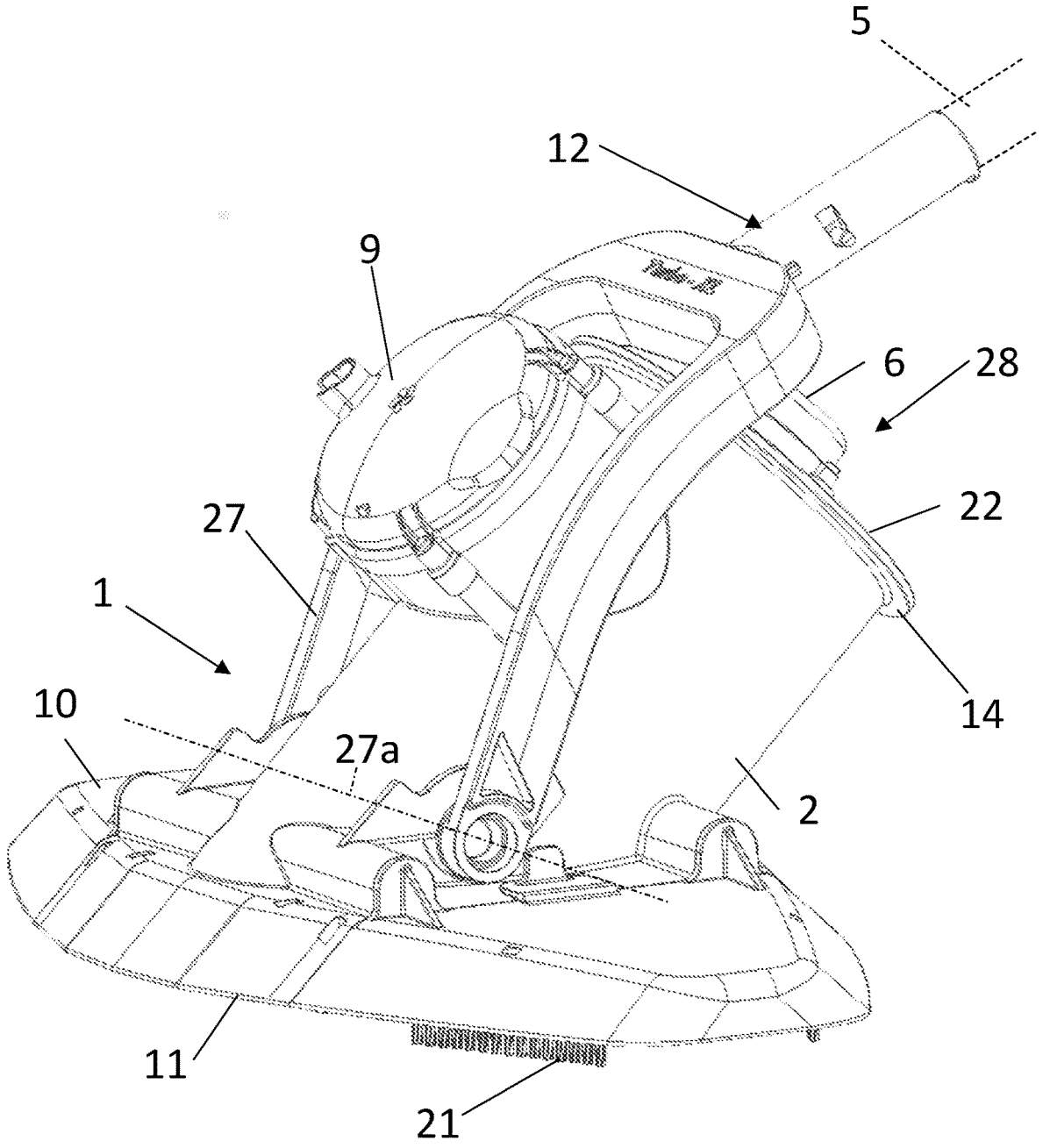
FIG. 2 shows the underwater cleaner according to the invention in a second pivot position of the guide fork in an axonometric illustration.

The battery-powered underwater cleaner 1 shown in FIGS. 1 to 8 respectively, for example for a swimming pool, has a housing 2 in which an impeller 3 with an electric motor 4 operates as a pump, wherein the impeller 3 is driven by the electric motor 4. The electric motor 4 and the bearing of the impeller 3 are accommodated in a pump housing 6, which is arranged in a flow channel 13 within the housing 2. The pump housing 6 is connected to the surrounding housing 2 by a suspension 7. Above the suspension 7, for example, rechargeable batteries are arranged on the upper side of the housing 2 in a battery space 8 formed by the housing 2. The battery space 8 is arranged in the housing 2 which is closed by a battery housing cover 9 in a watertight manner. The suspension 7 is hollow to accommodate therein the electrical connection between the electric motor 4 and the batteries 8.

In the embodiments shown, the impeller 3 is designed as an axial impeller.

The underwater cleaner 1 has a skirt-like suction nozzle 10 formed by the housing 2, the lower edge 11 of which, in operation, faces the surface to be cleaned and defines a suction plane 17 which is formed parallel to the contact plane 19. The contact plane 19 defined by the rollers 20 is parallel to the swimming pool surface to be cleaned during the operational use of the underwater cleaner 1. The skirt-like inner surface 10*a* of the suction nozzle 10 spans a suction chamber 30, from which the flow channel 13 extends.

In each of the exemplary embodiments shown, the housing 2 has a straight flow channel 13 which is arranged inclined with respect to a normal 25 to the suction plane 17. In an alternative embodiment, not shown, the flow channel 13 is slightly curved and has the shape of an arc. The wall of the flow channel 13 formed by the housing 2 is designated 13*a*.

Figure 7:
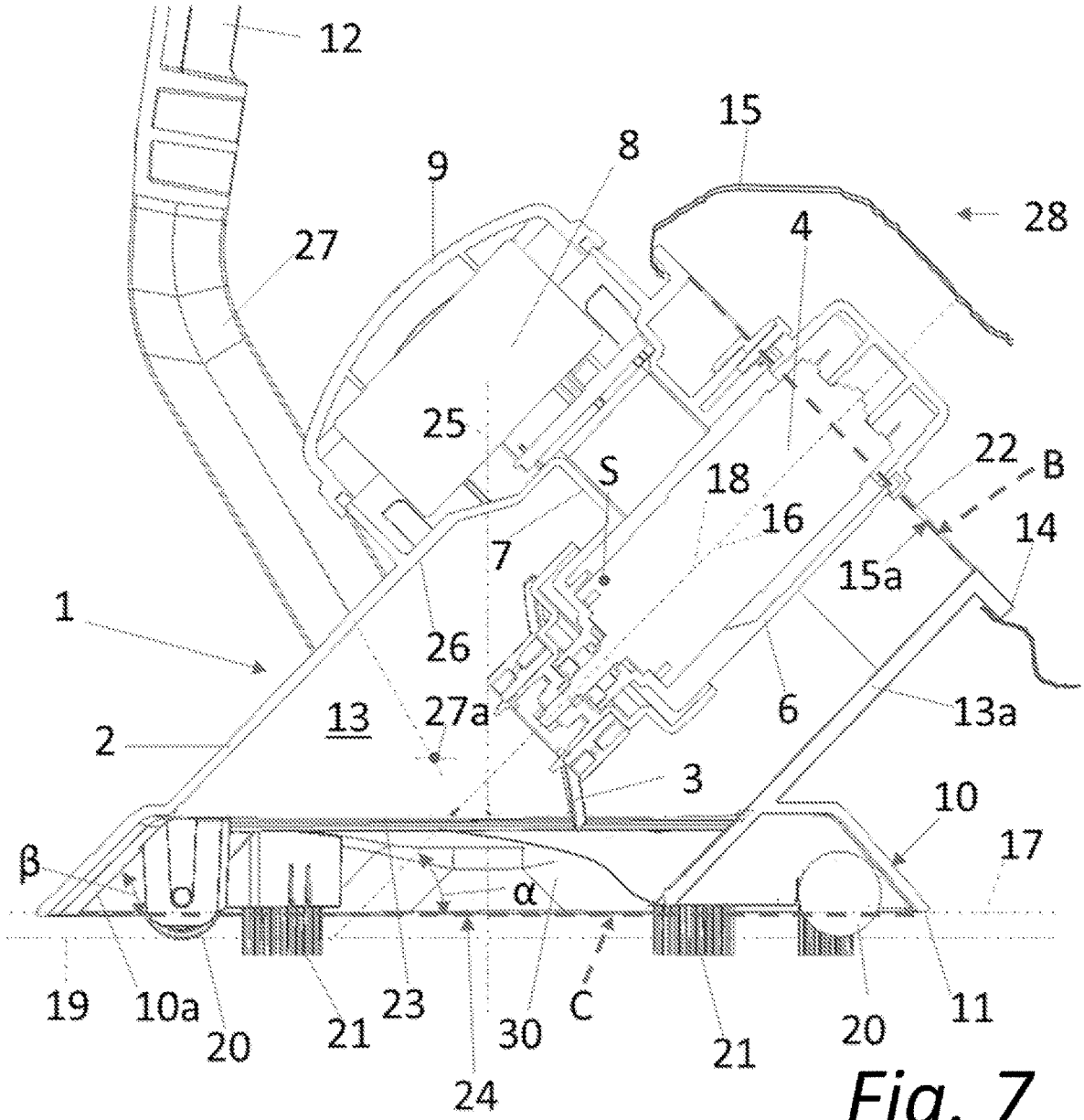
FIG. 7 shows the underwater cleaner in a third embodiment in a longitudinal section and FIG. 8 shows the underwater cleaner in a fourth embodiment in a longitudinal section.
Figure 8:
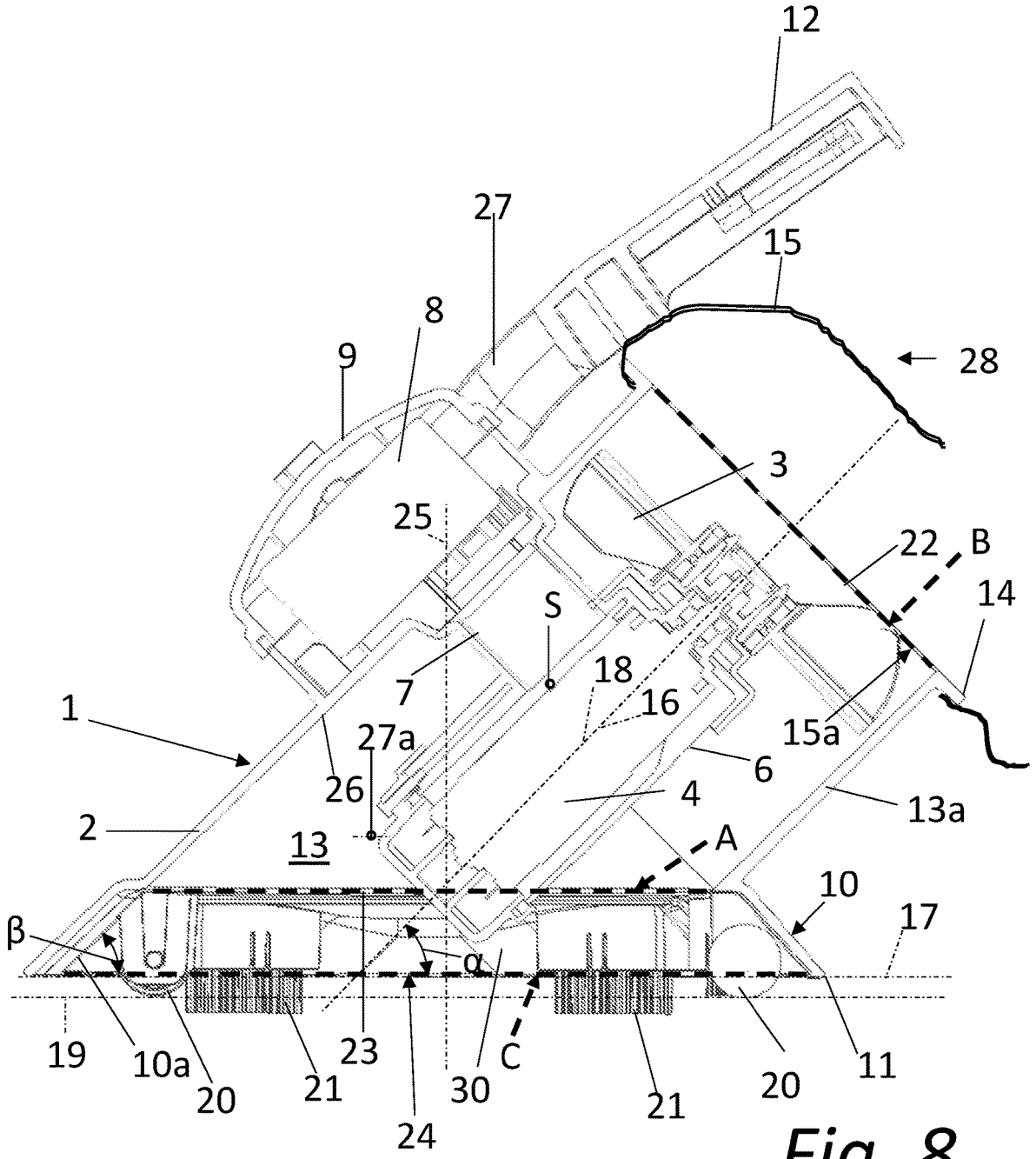

The pump housing 6 together with the electric motor 4 and the impeller 3 are arranged in the flow channel 13, wherein the impeller 3 is arranged in the region of the inlet opening 23 of the flow channel 13 (FIG. 3 to FIG. 7) or in the region of the outlet opening 22 of the flow channel 13 (FIG. 8). The flow channel 13 can have the shape, for example, of a hollow circular cylinder.

In the region of the outlet opening 22 arranged on the pressure side with respect to the impeller 3, a collar-like receptacle 14 is provided for a filter device 15 formed by a filter bag or a filter container. The outlet opening 22 and the receptacle 14 for the filter device 15 are arranged on an actuating side 28 of the housing 2 facing the user during operation.

In order to be able to move the underwater cleaner 1 on the swimming pool floor, the underwater cleaner 1 has a rod receptacle 12 with a guide fork 27 which is mounted on the housing 2—or directly on the suction nozzle 10—in the region of the upper side of the suction nozzle 10 so as to be pivotable about a pivot axis 27*a*. A guide rod indicated by reference sign 5 in FIG. 1 and FIG. 2 can be connected to the rod receptacle 12. FIG. 1 shows the guide fork 27 in a first pivot position and FIG. 2 in a second pivot position. At least in one pivot position, the guide fork 27 encompasses the housing 2 of the inclined flow channel 13 on both sides. The pivotability of the guide rod 5 enables the underwater cleaner 1 to be guided parallel to the floor.

Figure 5:
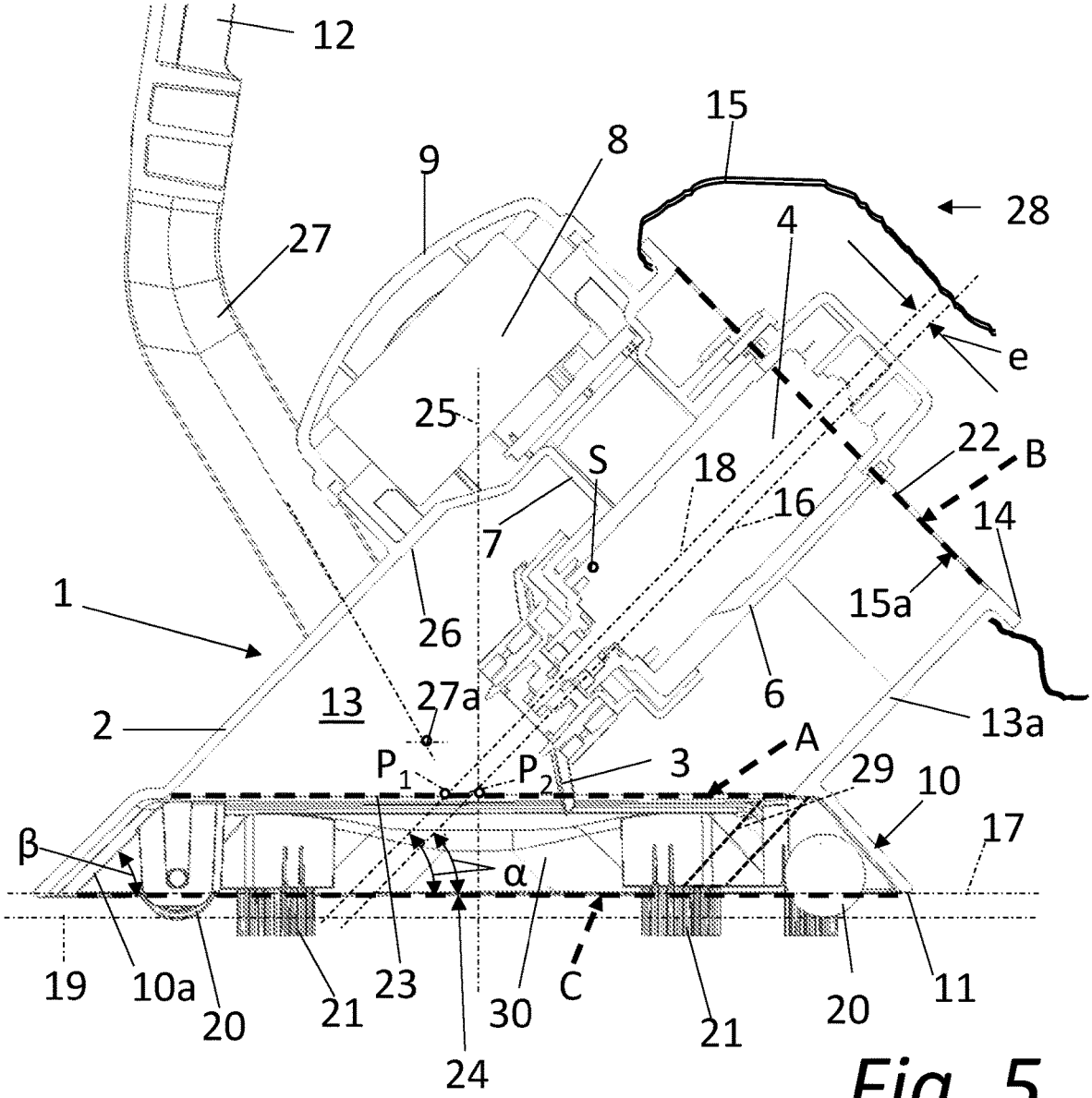
FIG. 5 shows the underwater cleaner in a second embodiment in a longitudinal section.

As can be seen clearly in FIG. 5, the pivot axis 27*a* of the guide fork 27 is arranged spaced apart from the center of mass S of the underwater cleaner 1, wherein the center of mass S is arranged between the pivot axis 27*a* and the outlet opening 22. When the underwater cleaner 1 is lifted, the housing 2 together with the filter device 15 pivots downwards on the actuating side 28, causing the opening 15*a* of the filter device 15 to be directed upwards. In this manner, resoiling from the filter device 15 can be effectively prevented when the underwater cleaner 1 is lifted.

In the embodiments illustrated, the impeller 3 has two impeller blades in each case, whereby leaves and other debris can be easily removed from the swimming pool surface to be cleaned and conveyed into the filter device 15.

The inlet opening 23 is located in the ceiling region of the skirt-like suction nozzle 10 and is formed parallel to the suction plane 17 which in operation is oriented parallel to the contact plane 19 of the suction nozzle 10. In operation, the contact plane 19 corresponds to the surface of the swimming pool to be cleaned.

In the illustrated exemplary embodiment, the entire flow channel 13 extending from the suction nozzle 10 is formed inclined with respect to the suction plane 17 and inclined with respect to the normal 25 to the suction plane 17. At least one reference line formed by the channel center axis 16 of the flow channel 13 or a surface line 26 of the flow channel 13 encloses an acute first angle α with the suction plane 17, at least in the region of the outlet opening 22. In the exemplary embodiment, the reference line formed by the channel center axis 16 or a surface line 26 of the flow channel 13 is a straight line. In an alternative embodiment, not shown, the reference line is arc-shaped. In this case, the first angle α is measured between a tangent to the reference line in the region of the outlet opening 22 and the suction plane 17. Both in the embodiment with a straight reference line and in the alternative embodiment with a arc-shaped reference line, it is possible to manufacture the housing 2 by injection molding and to demold the flow channel 13 using a pulled slider. The flow channel 13 can have a circular-cylindrical, elliptical or oval cross-section, wherein the surface lines 26 run parallel to the channel center axis 16, for example.

In each of the embodiments shown, the channel center axis 16 of the flow channel 13 and the impeller axis 18 enclose a first angle α of 30° to 75°, preferably about 45°±10°, with the suction plane 17 and the contact plane 19, respectively.

The skirt-like inner surface 10*a* of the suction nozzle 10 encloses an acute second angle R with the suction plane 17, which in the embodiments shown corresponds in size to the first angle α.

As can be seen in FIG. 3, FIG. 5, FIG. 7 and FIG. 8, the inlet opening 23 has in each case an inlet cross-sectional area A which is formed parallel to the suction plane 17 and at right angles to the normal 25 and which is larger than a flow cross-sectional area B designed to be normal to the channel center axis 16, for example in the region of the outlet opening 22. The ratio A/B of the inlet cross-sectional area A to the flow cross-sectional area B of the flow channel 13 is between 1.4 and 2.3, for example 1.9±10%.

In the region of the inlet opening 23 of the flow channel 13, the flow cross-section is thus greatly widened in order to be able to cover as large an area as possible by the suction effect. The inlet 24 to the suction nozzle 10 in the region of the suction plane 17 has an even larger cross-sectional area C, which is at least three times as large as the inlet cross-sectional area A. In the region of the inlet 24 of the suction nozzle 10 into the suction chamber 30, three rollers 20 are attached. These three rollers 20 serve to ensure that sufficient distance is maintained from the swimming pool surface to be cleaned so that the underwater cleaner 1 does not become stuck on the swimming pool surface and thus further movement is still possible. Brushes 21 which improve the cleaning result are arranged around the inlet opening 23 of the flow channel 13.

Figure 3:
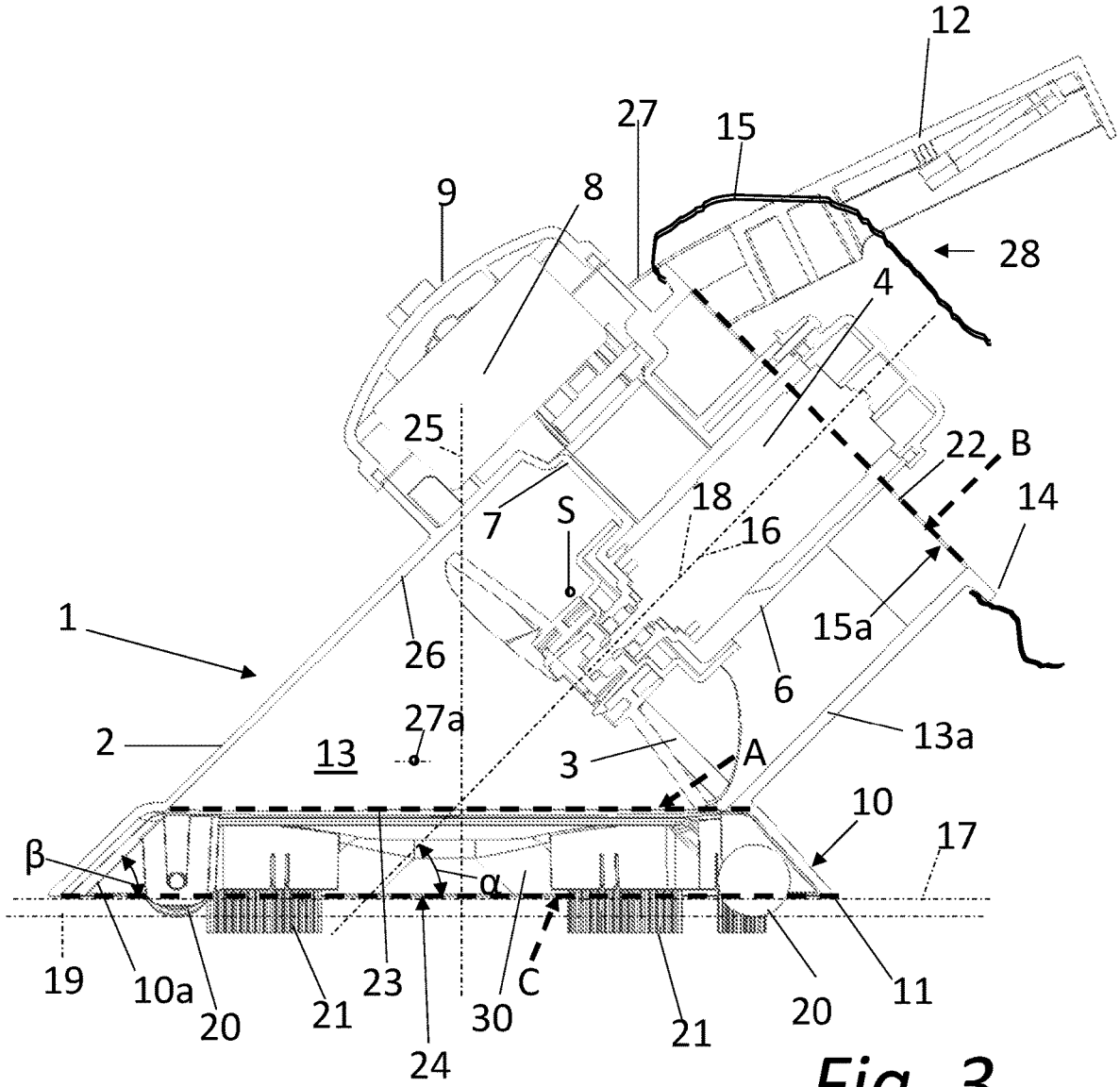
FIG. 3 shows the underwater cleaner in a first embodiment in a longitudinal section.
Figure 4:
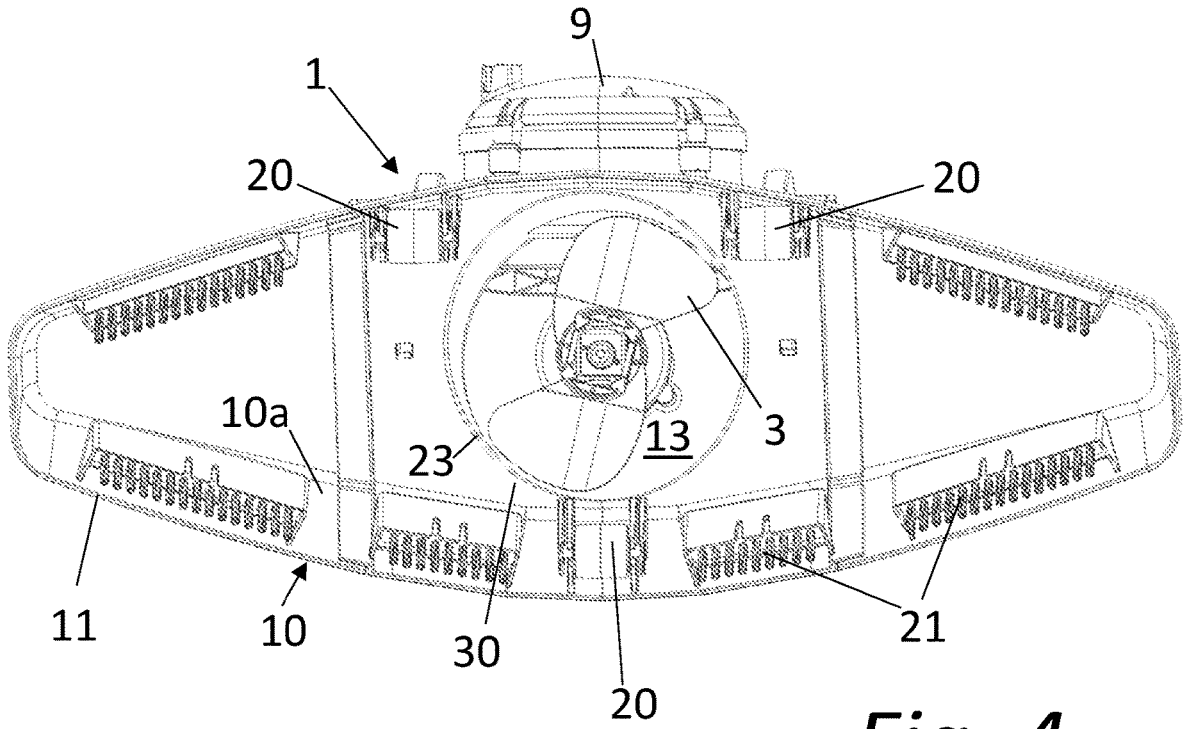
FIG. 4 shows the underwater cleaner in a bottom view.

FIG. 3 and FIG. 4 show a first embodiment of an underwater cleaner 1 according to the invention with high suction power in which the impeller 3 is arranged close to the inlet opening 23 of the flow channel 13, wherein the impeller axis 18 is coaxial with the channel center axis 16. The arrangement of the impeller 3 close to the bottom makes it possible that relatively heavy dirt particles, such as grains of sand and small stones, can also be sucked in.

Figure 6:
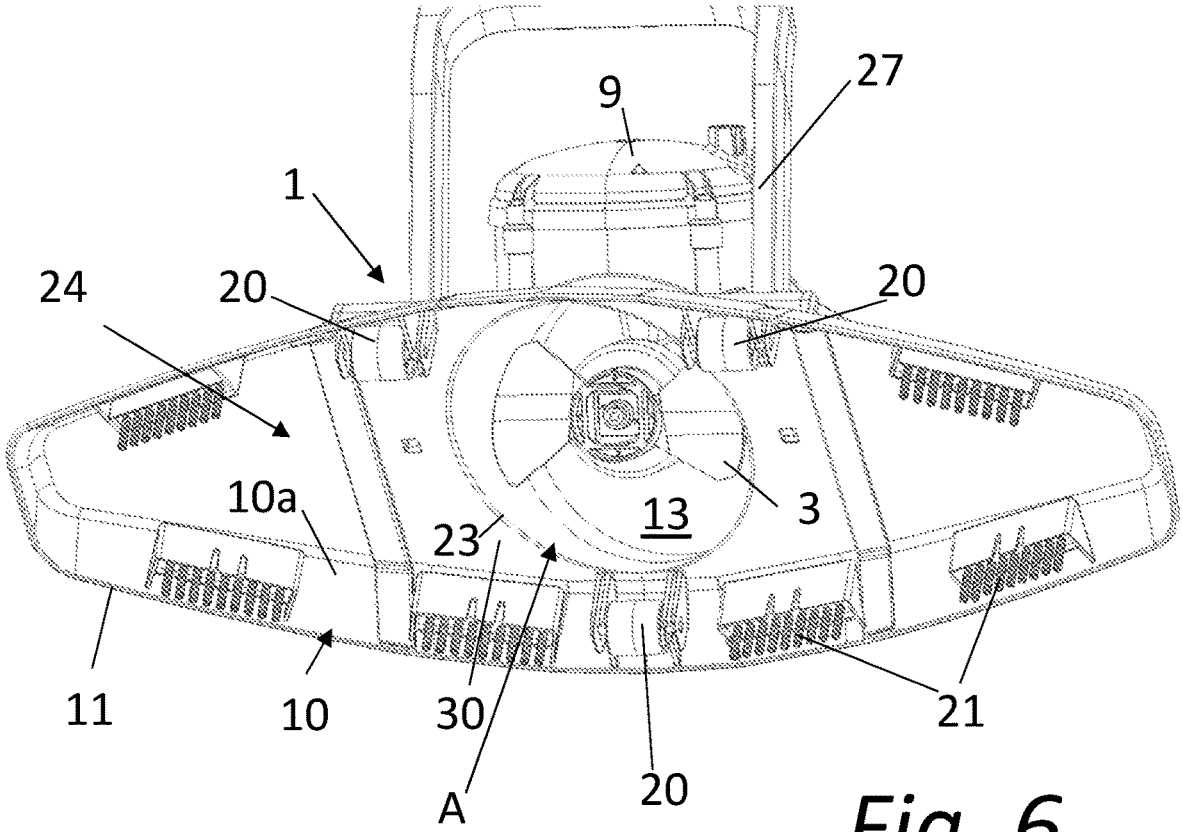
FIG. 6 shows this underwater cleaner in an axonometric view from the underside.

The second embodiment illustrated in FIG. 5 and FIG. 6 differs from FIG. 3 and FIG. 4 in that the impeller axis 18 is arranged slightly eccentric to the channel center axis 16. The eccentricity is designated by e. The eccentricity e is at most 10% of the largest diameter of the flow channel 13. In this case, a point of intersection $P_1$ of the impeller axis 18 with the inlet cross-sectional area A is located further away from the outlet cross-sectional area B than a point of intersection $P_2$ of the channel center axis 16 with the inlet cross-sectional area A. In other words—during operational use—the impeller axis 18 is located above the channel center axis 16. This allows for a very short and slim design of the underwater cleaner 1 and makes it possible to arrange the impeller 3 very close to the inlet 24 of the suction nozzle 10. In order to avoid or reduce short-circuit flows between the pressure side and the suction side of the impeller 3, a local wall extension 29, which is also injection-molded in the region of the inlet opening 23 and which reduces the flow cross-section and prevents backflow into the suction chamber 30, can be provided in the region of the flow channel 13 not covered by the rotating impeller 3. The wall extension 29 indicated by dashed lines in FIG. 5 can extend into the suction chamber 30. The wall extension 29 has the task of filling the region between impeller 3 and wall 13*a* of the flow channel 13.

A very close arrangement of the impeller 3 at the inlet 24 can also be achieved with an arrangement in which the impeller axis 18 is coaxial with the channel center axis 16 when the wall 13*a* extends into the suction chamber 30, as shown in FIG. 7.

In the fourth embodiment illustrated in FIG. 8, the impeller 3 is arranged in the region of the outlet opening 22 of the flow channel 13. This variant also enables a very short design of the underwater cleaner 1.

The invention claimed is:

1. An underwater cleaner, in particular for a swimming pool, with a housing in which a battery-powered pump with an electric motor and an impeller rotatable about an impeller axis of rotation is arranged, with a suction nozzle—defining a suction plane—formed by the housing, and a flow channel which is arranged in the housing and accommodates the impeller, is designed to be inclined with respect to the suction plane and which extends between an inlet opening arranged at or adjacent to the suction nozzle and an outlet opening, wherein a receptacle for a filter device is arranged at or adjacent to the outlet opening, and wherein the housing together with the suction nozzle can be manufactured by injection molding and the flow channel can be molded by a slider which can be pulled in the longitudinal direction of the flow channel, wherein the flow channel—at least at or adjacent to the outlet opening—is designed to be inclined with respect to a line normal to the suction plane, wherein at least one reference line formed by a feature selected from the group consisting of a channel center axis of the flow channel and a surface line of the flow channel encloses an acute first angle with the suction plane at least at or adjacent to the outlet opening, wherein the suction nozzle has a skirt-like inner surface which encloses an acute second angle with the suction plane which corresponds to the first angle.

2. The underwater cleaner according to claim 1, wherein the reference line encloses a first angle ≤75°, with the suction plane, at least at or adjacent to the outlet.

3. The underwater cleaner according to claim 1, wherein the reference line is formed as a straight line or as an arc of a circle.

4. The underwater cleaner according to claim 1, wherein the flow channel has a circular-cylindrical, elliptical or oval cross-section, wherein surface lines defining the flow channel run parallel to the channel center axis.

5. The underwater cleaner according to claim 1, wherein an accommodation space for a battery is integrated in the housing, wherein the accommodation space is arranged on a side of the flow channel facing away from the suction plane.

6. The underwater cleaner according to claim 1, wherein the inlet opening has a—substantially elliptical—inlet cross-sectional area which is larger than an outlet cross-sectional area of the flow channel, measured normal to the channel center axis—at or adjacent to the outlet opening.

7. The underwater cleaner according to claim 6, wherein the inlet cross-sectional area is arranged parallel to the suction plane.

8. The underwater cleaner according to claim 6, wherein the ratio of the inlet cross-sectional area to the outlet cross-sectional area of the flow channel measured normal to the channel center axis—at or adjacent to the outlet opening—is between 1.4 and 2.3.

9. The underwater cleaner according to claim 1, wherein the impeller is designed as an axial impeller.

10. The underwater cleaner according to claim 1, wherein the impeller is arranged at or adjacent to the inlet opening of the flow channel.

11. The underwater cleaner according to claim 1, wherein the impeller is arranged at or adjacent to the outlet opening of the flow channel.

12. The underwater cleaner according to claim 1, wherein the outlet opening and the receptacle for the filter device are arranged on an actuating side of the housing facing the user during operation.

13. The underwater cleaner according to claim 1, wherein a rod receptacle for detachable connection to a guide rod is arranged on a guide fork which is connected to the housing or to the suction nozzle so as to be pivotable about a pivot axis, wherein the guide fork encompasses the flow channel on both sides in at least one pivot position.

14. The underwater cleaner according to claim 13, wherein when viewed in plan view, the pivot axis is arranged spaced apart from a center of mass of the underwater cleaner, wherein the center of mass is arranged between the pivot axis and the outlet opening.

15. The underwater cleaner according to claim 1, wherein at least one reference line formed by a feature selected from the group consisting of a channel center axis of the flow channel and a surface line of the flow channel encloses an acute first angle with the suction plane at or adjacent to the inlet opening.

16. The underwater cleaner according to claim 1, wherein the reference line encloses a first angle ≤60°, with the suction plane, at least at or adjacent to the outlet opening.

17. The underwater cleaner according to claim 1, wherein the reference line encloses a first angle ≤45°, with the suction plane, at least at or adjacent to the outlet opening.

18. An underwater cleaner, in particular for a swimming pool, with a housing in which a battery-powered pump with an electric motor and an impeller rotatable about an impeller axis of rotation is arranged, with a suction nozzle—defining a suction plane—formed by the housing, and a flow channel which is arranged in the housing and accommodates the impeller, is designed to be inclined with respect to the suction plane and which extends between an inlet opening arranged at or adjacent to the suction nozzle and an outlet opening, wherein a receptacle for a filter device is arranged at or adjacent to the outlet opening, and wherein the housing together with the suction nozzle can be manufactured by injection molding and the flow channel can be molded by a slider which can be pulled in the longitudinal direction of the flow channel, wherein the flow channel—at least at or adjacent to the outlet opening—is designed to be inclined with respect to a line normal to the suction plane, wherein at least one reference line formed by a feature selected from the group consisting of a channel center axis of the flow channel and a surface line of the flow channel encloses an acute first angle with the suction plane at least at or adjacent to the outlet opening, wherein the impeller axis of rotation is arranged eccentrically in the flow channel, wherein an eccentricity measured between the impeller axis of rotation and the channel center axis is at most 10% of the largest diameter of the flow channel.

* * * * *